US009466456B2

(12) United States Patent
Rommel et al.

(10) Patent No.: US 9,466,456 B2
(45) **Date of Patent: *Oct. 11, 2016**

(54) X-RAY TUBE WITH ROTATING ANODE APERTURE

(71) Applicant: American Science and Engineering, Inc., Billerica, MA (US)

(72) Inventors: Martin Rommel, Lexington, MA (US); Peter Rothschild, Newton, MA (US)

(73) Assignee: American Science and Engineering, Inc., Billerica, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/753,276

(22) Filed: Jun. 29, 2015

(65) Prior Publication Data

US 2015/0303023 A1 Oct. 22, 2015

Related U.S. Application Data

(63) Continuation of application No. 13/869,101, filed on Apr. 24, 2013, now Pat. No. 9,099,279.

(60) Provisional application No. 61/638,555, filed on Apr. 26, 2012.

(51) Int. Cl.

| | |
|---|---|
| ***H01J 35/10*** | (2006.01) |
| ***G21K 1/04*** | (2006.01) |
| ***H01J 35/16*** | (2006.01) |

(52) U.S. Cl.

CPC ..... *H01J 35/10* (2013.01); *G21K 1/043* (2013.01); *H01J 35/16* (2013.01); *H01J 2235/06* (2013.01); *H01J 2235/086* (2013.01); *H01J 2235/16* (2013.01)

(58) Field of Classification Search

CPC .... H01J 35/10; H01J 35/16; H01J 2235/086; H01J 2235/16

USPC ..... 378/125, 144, 146, 147

See application file for complete search history.

(56) References Cited

U.S. PATENT DOCUMENTS

| | | | | |
|---|---|---|---|---|
| 3,780,291 | A * | 12/1973 | Stein | G01N 23/043 250/368 |
| 3,836,804 | A | 9/1974 | Frens et al. | 313/60 |
| 4,991,194 | A | 2/1991 | Laurent et al. | 378/144 |
| 5,689,542 | A | 11/1997 | Lavering et al. | 378/142 |

(Continued)

FOREIGN PATENT DOCUMENTS

| | | | |
|---|---|---|---|
| WO | WO 01/09594 A2 | 2/2001 | G01N 23/00 |

OTHER PUBLICATIONS

Varian Medical Systems, Varian G-292 Specification Sheet, 12 pages (Mar. 2009).

(Continued)

*Primary Examiner* — Allen C. Ho

(74) *Attorney, Agent, or Firm* — Sunstein Kann Murphy Timbers LLP

(57) ABSTRACT

An x-ray tube for generating a sweeping x-ray beam. A cathode is disposed within a vacuum enclosure and emits a beam of electrons attracted toward a rotating anode. The rotating anode is adapted for rotation with respect to the vacuum enclosure about an axis of rotation. At least one collimator opening or aperture corotates with the rotating anode within the vacuum enclosure, such that a swept x-ray beam is emitted.

4 Claims, 4 Drawing Sheets

(56) References Cited

U.S. PATENT DOCUMENTS

| | | | | |
|---|---|---|---|---|
| 5,907,592 | A | 5/1999 | Levinson | 378/4 |
| 6,125,167 | A | 9/2000 | Morgan | 378/124 |
| 6,229,870 | B1 * | 5/2001 | Morgan | A61B 6/032 378/4 |
| 6,356,620 | B1 * | 3/2002 | Rothschild | A61B 6/032 378/137 |
| 6,487,274 | B2 | 11/2002 | Bertsche | 378/143 |
| 6,522,721 | B1 * | 2/2003 | Lustberg | H01J 35/10 378/125 |
| 6,546,079 | B2 | 4/2003 | Fritsch | 378/140 |
| 6,560,315 | B1 | 5/2003 | Price et al. | 378/144 |
| 6,618,465 | B2 | 9/2003 | Mohr et al. | 378/58 |
| 6,674,838 | B1 * | 1/2004 | Barrett | H01J 35/106 378/125 |
| 6,947,522 | B2 | 9/2005 | Wilson et al. | 378/125 |
| 6,975,703 | B2 | 12/2005 | Wilson et al. | 378/124 |
| 7,197,116 | B2 | 3/2007 | Dunham et al. | 378/124 |
| 7,266,179 | B2 * | 9/2007 | Deuringer | H01J 35/14 378/137 |
| 7,302,044 | B2 | 11/2007 | Gabioud | 378/144 |
| 7,305,066 | B2 | 12/2007 | Ukita | 378/126 |
| 7,529,343 | B2 * | 5/2009 | Safai | G21K 1/043 378/125 |
| 7,599,471 | B2 | 10/2009 | Safai et al. | 378/125 |
| 7,949,102 | B2 * | 5/2011 | Behling | A61B 6/032 378/119 |
| 8,126,116 | B2 | 2/2012 | Bathe | 378/125 |
| 8,189,742 | B2 | 5/2012 | Behling | 378/137 |
| 8,553,844 | B2 | 10/2013 | Lewalter et al. | 378/127 |
| 8,687,769 | B2 | 4/2014 | Behling | 378/134 |
| 8,761,338 | B2 * | 6/2014 | Safai | G01N 23/203 378/197 |
| 9,099,279 | B2 * | 8/2015 | Rommel | H01J 35/10 |
| 9,151,721 | B2 * | 10/2015 | Safai | G01N 23/203 |
| 2005/0265521 | A1 | 12/2005 | Deuringer et al. | 378/138 |
| 2007/0269014 | A1 | 11/2007 | Safai et al. | 378/143 |
| 2010/0046716 | A1 * | 2/2010 | Freudenberger | H01J 35/16 378/140 |
| 2011/0268247 | A1 | 11/2011 | Shedlock et al. | 378/62 |
| 2014/0126698 | A1 * | 5/2014 | Behling | H01J 35/10 378/62 |

OTHER PUBLICATIONS

Kim Do Weon, Authorized officer Korean Intellectual Property Office, International Search Report—Application No. PCT/US2013/037911, dated Aug. 13, 2013, including the Written Opinion of the International Searching Authority (7 pages).

* cited by examiner

X-RAY TUBE WITH ROTATING ANODE APERTURE

The present application is a continuation application of U.S. Ser. No. 13/869,101, now issued as U.S. Pat. No. 9,099,279, and, through that application, claims priority from U.S. Provisional Patent Application Ser. No. 61/638,555, filed Apr. 26, 2012. Both of the aforementioned applications are incorporated herein by reference.

TECHNICAL FIELD

The present invention relates to sources of X-ray radiation, and, more particularly, to an X-ray tube with a rotating anode.

BACKGROUND OF THE INVENTION

X-ray backscatter imaging relies on scanning an object with a well-collimated beam, typically referred to as "pencil beam". Several approaches for forming the collimated scanning beam have been suggested. Commonly, beam formation and steering relies on an aperture moving in front of a stationary X-ray tube. In most cases the radiation from an X-ray tube is first collimated into a fan beam by a stationary collimator. Then, a moving part with an opening forms a scanning beam. This moving part can be, for example, a rotating disk with radial slits, or a wheel with openings at the perimeter. The rotating disk covers the fan beam and the scanning beam is formed by the radiation emitted through the slits traversing the length of the fan beam opening. This approach is illustrated, e.g., in the U.S. Pat. No. 3,780,291 (to Stein and Swift). In the case of a rotating wheel, a wheel with radial bores spins around the X-ray source. If the source is placed at the center of the wheel (or hub), the scanning beam is emitted in radial direction with the angular speed of the wheel. Alternatively, the source may be placed off-center with respect to the rotating wheel, which changes the beam geometry.

In most X-ray tubes, an electron beam impinges upon a stationary target, which, in turn, gives off X-ray radiation produced by stopping the fast electrons, i.e., Bremsstrahlung. Most of the kinetic energy of the electron beam is converted into heat and only a small fraction is given off as X-rays. For imaging purposes, a small electron beam focal spot is desirable, however anode heating limits the acceptable current for a given focal spot size.

To allow smaller focal spots, X-ray tubes 100 have been designed to have rotating anodes, as depicted in FIG. 1. X-ray tube 100 represents a typical design, as produced, for example, by Varian Medical Systems. Rotating anode 102 distributes the heat over a larger area and allows a considerably smaller focal spot 104 of electrons 106 emanating from cathode block 107 than would be possible using a stationary anode. Rotating anode 102 is rotated by rigid coupling to rotor 108 which moves relative to stator 110. X-rays 112 are emitted through exit window 114, and they are subsequently collimated by some external collimating structure.

SUMMARY OF EMBODIMENTS OF THE INVENTION

In accordance with various embodiments of the present invention, an X-ray tube is provided that both generates and collimates an X-ray beam. The X-ray tube has a vacuum enclosure, a cathode disposed within the vacuum enclosure for emitting a beam of electrons, and an anode adapted for rotation with respect to the vacuum enclosure about an axis of rotation. The X-ray tube also has at least one collimator opening adapted for co-rotation with respect to the anode within the vacuum enclosure.

In accordance with other embodiments of the present invention, the collimator opening or openings may be disposed within the anode itself. Each collimator opening may be contiguous with a wedge opening in the anode.

In accordance with further embodiments of the present invention, the X-ray tube may have an external collimator opening disposed outside the vacuum enclosure. The collimator openings (or opening) may be disposed above a plane transverse to the axis of rotation containing a locus of focal spots of the beam of electrons.

BRIEF DESCRIPTION OF THE FIGURES

The foregoing features of the invention will be more readily understood by reference to the following detailed description, taken with reference to the accompanying figures, in which.

DETAILED DESCRIPTION OF EMBODIMENTS OF THE INVENTION

Figure 1:
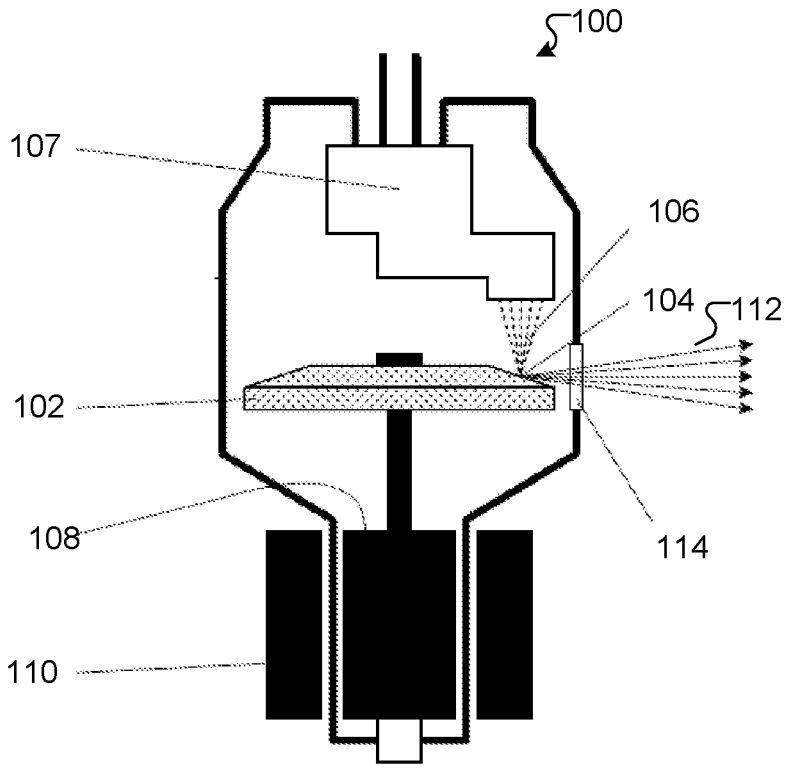
PRIOR ART Fig. 1
FIG. 1 shows an X-ray tube with a rotating anode as practiced in the prior art.
Figure 2:
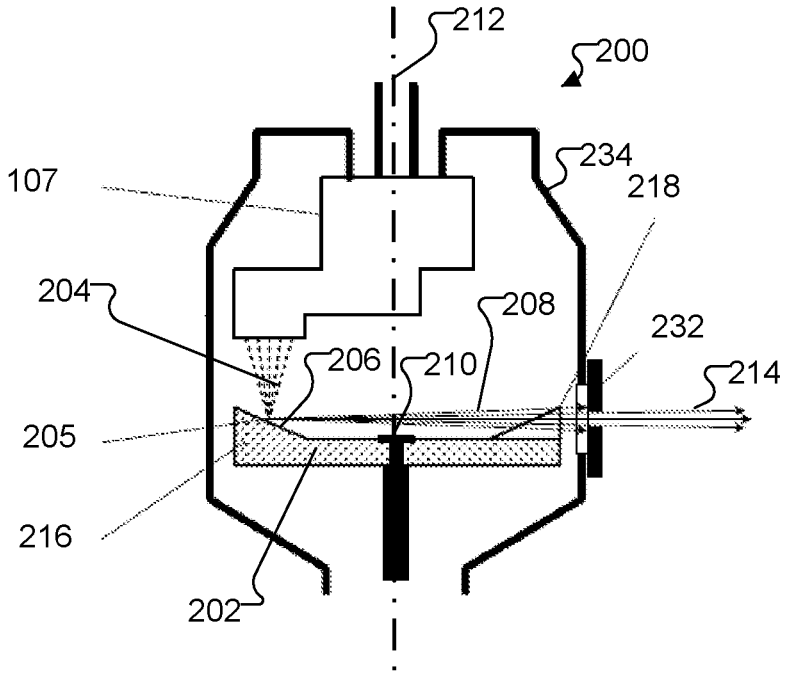
FIG. 2 shows a cross-sectional side view of an X-ray tube with a concave rotating anode in accordance with an embodiment of the present invention.
Figure 3:
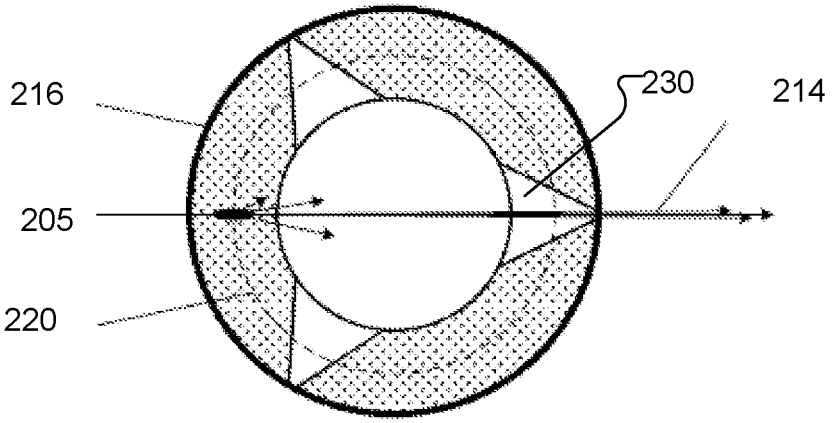
FIG. 3 shows a cross-sectional top view of the anode associated with the X-ray tube shown in FIG. 2.
Figure 4:
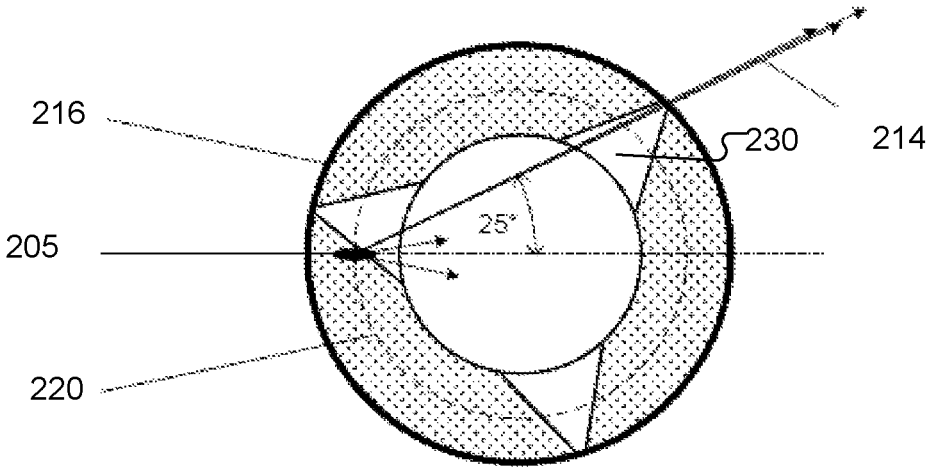
FIG. 4 is the same view as that of FIG. 3, but now the rotating anode has been rotated relative to the cathode block in order to illustrate a near-extremal position of the beam span, in accordance with an embodiment of the present invention.

In accordance with embodiments of the present invention, described now with reference to FIGS. 2-6, an X-ray tube 200 is provided that uses a rotating anode, not only to distribute the heat, but also to act as a rotating collimator to create a scanning beam. To that end, referring first to FIG. 2, rotating anode 202 is preferably concave, with an electron beam 204 impinging upon focal spot 205 on an inner surface 206 in such a manner that the X-rays 208 are emitted towards the center 210 of rotating anode 202. In the embodiment depicted in FIG. 2, X-rays 208 are emitted perpendicularly to axis of rotation 212 about which rotating anode 202 rotates. The elevated rim 216 of rotating anode 202 may also be referred to herein as an anode "ring" 216. To form a scanning collimated pencil beam 214, anode ring 216 has openings 218 which allow X-rays 208 to be emitted out of the tube X-ray tube 200. In the depicted embodiment, anode ring 216 has three openings 120° apart creating a scanning beam coverage of approximately 50°. FIG. 3 is a top cross-sectional view of rotating anode 202 of FIG. 2. The circular focal spot path 220 comprises the locus of regions serving as focal spot 205 as rotating anode 202 rotates. Partially collimated pencil beam 214 emerges from wedge opening 230. An external collimator slit 232 may be situated outside glass envelope 234 of the X-ray tube 200. In FIG. 4, rotating anode 202 has been rotated relative to the cathode block 107 in order to illustrate a near-extremal position of the beam span, where the focal spot 205 will fall into the wedge opening 230 just as collimated pencil beam 214 is about to be vignetted by an edge of wedge opening 230.

More generally, within the scope of the present invention, opening 218 is to be considered an instance of a collimator aperture which co-rotates with rotating anode 202, whether or not the aperture is integral with the rotating anode 202.

Figure 5:
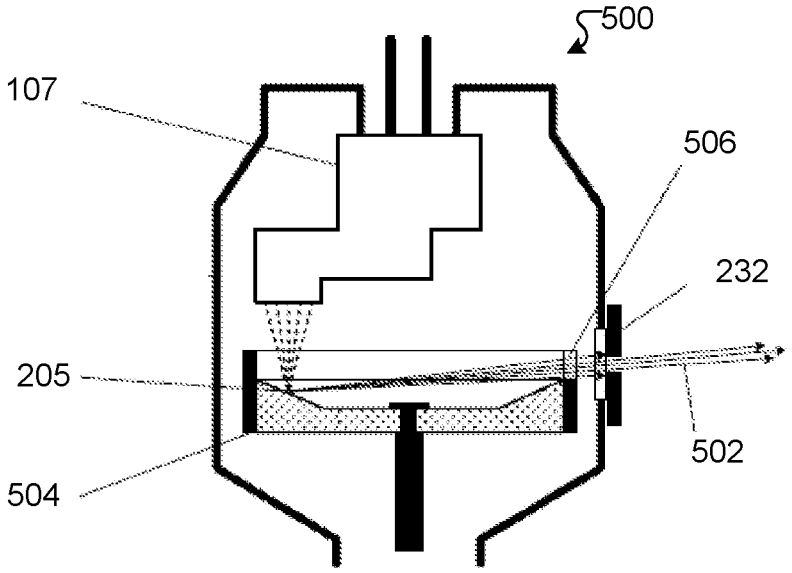
FIG. 5 shows a cross-sectional side view of an X-ray tube with a concave rotating anode and out-of-plane rim wall collimator, in accordance with an embodiment of the present invention.
Figure 6:
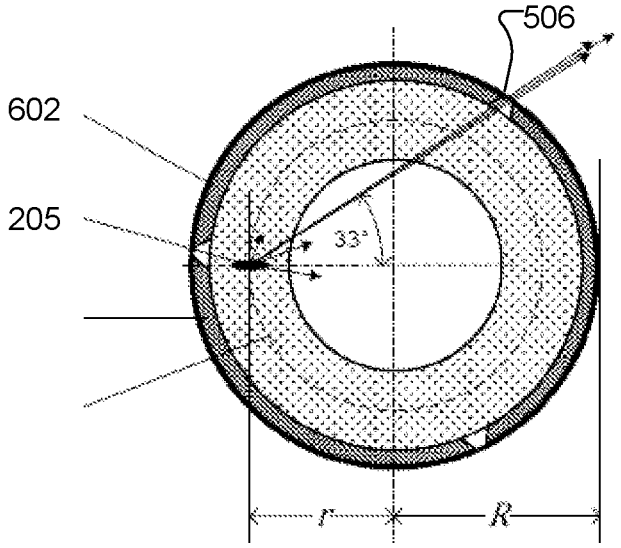
FIG. 6 is a top view of the anode associated with the X-ray tube shown in FIG. 5.

In the embodiment of rotating anode X-ray tube 500, depicted in FIG. 5, X-rays 502 are emitted at a slight angle to clear the height of the slanted rotating anode 504. This eliminates the need to cut openings into the slanted anode area and thus allows for continuous X-ray generation not interrupted by gaps in the anode area. X-rays 502 are emitted, instead, through an aperture 506 above the plane transverse to axis of rotation axis 212 containing the intersection of focal spot 205 with the surface of slanted rotating anode 504. A further advantage of this design is the greater flexibility in choosing the number of apertures 506. FIG. 6 is a top view of the anode of FIG. 5.

The largest possible angular span of the scanning beam depends on the number of apertures 506 in the anode ring wall 602 as well as on the ratio of the anode ring wall diameter 2R to the distance r between the focal spot and the axis of rotation 212, see FIG. 6. A single aperture 506 theoretically allows for a 360° angular beam span. For two opposite apertures 506, the theoretical beam span is twice the arc tangent of the ratio R/r, where, as shown in FIG. 6, R is the radius of an anode ring wall 602, and r is the radial distance from the axis of rotation 212 to focal spot 205. Using three equally spaced apertures 506 limits the theoretical beam span to twice the arc tangent of the ratio $$\frac{\sqrt{3}\,R}{(2r+R)}.$$

These formulas are exact for a dimensionless focal spot 205 and an infinitesimally thin anode ring wall 602. Assuming the anode ring wall radius R is 4/3 of the focal spot distance r, two opposite apertures 506 create a span of about 106°; three equally spaced apertures 506 create a span of just over 69°.

In preferred embodiments of the present invention, the apertures 506 in the anode ring wall 602 are vertical cuts (parallel to the axis of rotation 212) and the collimation in the vertical direction is accomplished by an external collimator slit 232 positioned outside the x-ray tube 500. In order for the scanning beam to span a plane without curvature, the external collimator slit 232 should be coplanar with the focal spot 205.

X-ray tubes with anodes rotating at up to 10,000 rpm are commercially available. With three openings apertures 506 and 150 rotations per second, X-ray tube 500, in accordance with embodiments of the present invention, creates a scan rate of 450 lines per second, a rate compatible, for example, with typical applications like whole body scanners.

Where examples presented herein involve specific combinations of method acts or system elements, it should be understood that those acts and those elements may be combined in other ways to accomplish the same objective of x-ray scanning Additionally, single device features may fulfill the requirements of separately recited elements of a claim. The embodiments of the invention described herein are intended to be merely exemplary; variations and modifications will be apparent to those skilled in the art. All such variations and modifications are intended to be within the scope of the present invention as defined in any appended claims.

What is claimed is:

1. An X-ray tube comprising:

a. a vacuum enclosure;

b. a cathode disposed within the vacuum enclosure for emitting a beam of electrons;

c. an anode adapted for rotation within the vacuum enclosure about an axis of rotation; and d. at least one collimator opening, disposed within the vacuum enclosure, adapted for rotation about the axis of rotation, and for periodic transmission therethrough of x-rays produced at the anode.

2. An X-ray tube in accordance with claim 1, wherein the at least one collimator opening is coupled to the anode.

3. An X-ray tube in accordance with claim 1, wherein the anode includes a wedge opening and the at least one collimator opening is contiguous with the wedge opening.

4. An X-ray tube in accordance with claim 1, further comprising an external collimator opening disposed outside the vacuum enclosure.

* * * * *